US008070381B2

(12) United States Patent
Bown et al.

(10) Patent No.: US 8,070,381 B2
(45) Date of Patent: Dec. 6, 2011

(54) ROAD STUD

(75) Inventors: Lou Bown, Hampshire (GB); Dave Hill, Hampshire (GB); Rod Ashton, Hampshire (GB)

(73) Assignee: Industrial Rubber PLC (GB)

( * ) Notice: Subject to any disclaimer, the term of this patent is extended or adjusted under 35 U.S.C. 154(b) by 668 days.

(21) Appl. No.: 11/914,934

(22) PCT Filed: May 19, 2006

(86) PCT No.: PCT/GB2006/001883
§ 371 (c)(1),
(2), (4) Date: Nov. 19, 2007

(87) PCT Pub. No.: WO2006/125968
PCT Pub. Date: Nov. 30, 2006

(65) Prior Publication Data

US 2008/0179791 A1 Jul. 31, 2008

(30) Foreign Application Priority Data

May 23, 2005 (GB) ..... 0510492.2
Mar. 3, 2006 (GB) ..... 0604362.4

(51) Int. Cl.
*E01F 9/06* (2006.01)

(52) U.S. Cl. ..... 404/10; 404/13

(58) Field of Classification Search ..... 404/9, 11, 404/12, 13, 14, 15, 16; 116/63 R
See application file for complete search history.

(56) References Cited

U.S. PATENT DOCUMENTS

| | | | | | |
|---|---|---|---|---|---|
| 4,130,370 | A | * | 12/1978 | Kone | 404/11 |
| 4,237,191 | A | | 12/1980 | Horne | |
| 4,883,384 | A | * | 11/1989 | Hedgewick | 404/14 |
| 5,168,827 | A | * | 12/1992 | Junker | 116/63 P |
| 5,197,819 | A | * | 3/1993 | Hughes | 404/13 |
| 5,895,170 | A | * | 4/1999 | Chambers et al. | 404/10 |
| 6,019,543 | A | * | 2/2000 | Junker | 404/10 |
| 6,264,860 | B1 | | 7/2001 | Attar | |
| 6,461,077 | B1 | | 10/2002 | Siblik | |

(Continued)

FOREIGN PATENT DOCUMENTS

EP 0644297 A2 9/1994

(Continued)

*Primary Examiner* — Gary S Hartmann
(74) *Attorney, Agent, or Firm* — Park, Vaughan, Fleming & Dowler LLP

(57) ABSTRACT

A base unit for a road stud is provided. In one embodiment, the base unit is made of plastic and has a recess with a plurality of projections. The projections extend over the floor of the recess for retaining a resilient insert within the recess. The base unit comprises a first portion representing the body of the base unit, and one or more additional portions fitted to said first portion, for example by adhesive bonding. Each of said projections may be formed from one or more planar elements. The base unit further has a front portion, a back portion, and opposing side walls, wherein the recess is located between the front and back portion and the opposing side walls. The underside of the front and back portions is provided with ribbing for transverse strengthening. A cavity is formed in the underside of each of the opposing side walls. A colorant may be added to the plastic of the base unit in order to color the base unit, for example to match the color of reflectors provided in the insert. The top surface of the base unit may be provided with an anti-skid pattern.

14 Claims, 12 Drawing Sheets

Figure 1

Figure 6

U.S. PATENT DOCUMENTS

| | | | |
|---|---|---|---|
| 2005/0025570 | A1 | 2/2005 | Snagel |

FOREIGN PATENT DOCUMENTS

| | | | |
|---|---|---|---|
| EP | 0644297 | A3 | 9/1994 |
| GB | 570676 | | 9/1943 |
| GB | 570964 | | 9/1944 |
| GB | 648542 | | 1/1949 |
| GB | 651541 | | 2/1949 |
| GB | 696707 | | 2/1952 |
| GB | 1028832 | | 3/1965 |
| GB | 2147038 | A | 5/1985 |
| GB | 2167793 | A | 6/1986 |
| GB | 2280922 | A | 2/1995 |
| GB | 2312458 | A | 10/1997 |
| GB | 2386365 | A | 8/2003 |
| WO | 9636770 | A1 | 4/1996 |
| WO | 2004101895 | A1 | 11/2004 |

* cited by examiner

ROAD STUD

FIELD OF THE INVENTION

The present invention relates to road studs, and in particular to a base unit made of plastic for such a road stud.

BACKGROUND OF THE INVENTION

Road studs are in widespread use to provide visible guidance and warnings to motorists and other road users. Such road studs typically include one or more reflectors made out of glass or plastic to reflect light from vehicle headlights. The road studs help a motorist to determine his or her position on the road during hours of darkness.

There are two main types of road stud in use in the UK. The first is generally known as a "stick on", and is normally formed from a plastic unit incorporating one or more plastic reflectors. Plastic stick-on reflectors are placed on top of the surface of the road and are attached to the road by adhesive. They are relatively cheap but also have a relatively short life-time. For example, they may become detached from the road surface by passing traffic, and/or the visibility of the reflector may become reduced, for example by dirt being deposited onto the surface of the reflector.

The other main type of road stud in use in the UK is a depressible (also sometimes referred to as a "cat's eye"). This comprises a base unit, normally made of cast iron, which holds a resilient insert. The insert is typically made of rubber, and carries one or more glass or plastic reflectors. This type of road stud is installed by drilling a hole in the road, and then bonding the road stud into location using bitumen or some other road grout.

The inserts for depressible road studs are generally provided with one or more wiper blades. When the insert is compressed, for example because a lorry has driven over the road stud, these blades are designed to wipe across the reflectors. This helps to keep the surface of the reflectors free from dirt, and hence helps to maintain high visibility.

One example of a depressible road stud is described in GB 2263298 B. A road stud generally in accordance with this patent is sold commercially under the "Light Dome" trademark by Industrial Rubber plc, of Fareham, Hampshire. The insert described in this patent includes ducts to allow water that has collected in the base of the road stud to be applied to the wiper blades. The water helps to lubricate the wiping action of the blades on the reflectors, thereby reducing wear, as well as assisting with the overall cleaning process.

It is also known to make a hybrid road stud, which involves a plastic reflector stuck on to a cast iron base unit that is sunk into the road. This road stud is designed to ensure greater permanence for the reflector (compared to adhering the plastic reflector directly onto the road surface), but does not have the wiping action of a depressible to keep the reflector clean. The use of this hybrid road stud has been rather limited in practice.

The typical weight of a conventional base unit made of cast iron is approximately 5 kg. Although the large weight of the base unit assists in retaining the stud in the road, it does mean that the base units are relatively expensive to transport around the country since they are so heavy. In addition, it is difficult to machine lay such heavy road studs. Rather, the road studs are generally laid by manual workers by hand. However, the weight of the stud may cause some safety concerns, for example a base unit might cause injury if dropped onto the foot of a worker.

It has been contemplated for many years that the base unit of a depressible road stud could be made of plastic rather than of metal. For example, GB 2280922 A suggests a base unit formed of a plastic material such as nylon. The use of a plastic base is also suggested in GB 2121463 A and GB 2229470 A. Nevertheless, no-one has yet managed to bring a successful plastic base unit for a depressible road stud to the market, and all depressible road studs in use in the UK still have metal base units.

SUMMARY OF THE INVENTION

One embodiment of the invention provides a base unit for a road stud. The base unit is made of plastic and has a recess with a plurality of projections. The projections extend over the floor of the recess for retaining a resilient insert within the recess. The base unit comprises a first portion representing the body of the base unit, and one or more additional portions fitted to the first portion.

Such an arrangement aids manufacture of the body of the base unit, especially by injection moulding. The one or more additional portions can then be fitted to body of the base unit by any suitable technique, such as by adhesive bonding, a snap or press fit, or by acoustic welding.

In some embodiments, the projections are formed as part of the body portion, and the one or more additional portions comprise at least the part of the floor of the recess located beneath these projections. Such an arrangement helps allow the body portion to be removed from the mould, since the projections can fit through the hole(s) in the mould corresponding to where the one or more additional portions are to be fitted. Various configurations are possible. For example, in one embodiment there is at least one projection on each of two opposing sides of the recess, and the one or more additional portions comprise a single floor piece that extends from one of said opposing sides to the other. In another embodiment, there is at least one projection on each of two opposing sides of the recess. The one or more additional portions then comprise a first floor piece located adjacent to one of said two opposing sides, and a second floor piece located adjacent to the other of said two opposing sides. In another embodiment, there are multiple projections on each of two opposing sides of the recess, and the one or more additional portions comprise a separate floor piece located underneath each of the projections.

In some other embodiments, the projections are formed as part of the one or more additional portions. For example, the one or more additional portions may comprise a tray incorporating the projections that is fitted into said recess. The tray may provide at least part of the floor of the recess.

In some embodiments, each of the one or more additional portions is fitted into a corresponding aperture in the body of the base unit. At least part of the walls of the aperture are profiled to provide a greater contact area with the corresponding additional portion, for example, the walls may be slanted or stepped. The additional portion to fit into the aperture then has a corresponding shape. The greater contact area helps to provide improved bonding between the fitted portion and the body of the base unit (for example if adhesive is being used to retain the fitted portion in the base unit). In addition, the fitted portion can abut against a portion of the aperture wall, thereby helping to position and hold the fitted portion correctly with respect to the body of the base unit.

The invention also provides a method of making a base unit for a road stud, the base unit being made of plastic and having a recess with a plurality of projections, the projections extending over the floor of the recess for retaining a resilient insert within the recess. The method comprises: injection moulding a body of the base unit; removing the body from the mould; and fitting the one or more additional portions to the floor of the recess.

Another embodiment of the invention provides a base unit for a road stud. The base unit is made of plastic and has a front portion, a back portion, and opposing side walls. The front portion and the back portion each has a cavity formed thereunder. A recess for locating an insert is provided between the front portion, the back portion, and the opposing side walls. The underside of the front and/or back portion is provided with ribbing across the corresponding cavity. In general it is expected that the front and back portions are both provided with the same pattern of ribbing. The ribbing may also extend under the recess between the front and back portions.

In one embodiment, at least some of the ribbing is transverse to provide transverse strengthening. Existing cast iron base units may include some longitudinal strengthening underneath the front and back portions, which is generally intended to provide reinforcement against brittleness, especially in relation to frontal impacts from oncoming traffic. In contrast, a plastic base unit may also be subject to flexure or other forms of distortion. The provision of the transverse strengthening therefore provides protection against such flexure, which might otherwise weaken or crack the base unit, or allow the insert to be accidentally removed more easily.

In one embodiment, the ribbing for transverse strengthening comprises a single latitudinal (traqnsverse) rib for the front portion and/or for the back portion, while in another embodiment the ribbing for transverse strengthening comprises multiple latitudinal ribs for the front portion and/or for the back portion. In another embodiment, there is a longitudinal rib located along the central axis of the base unit, and the transverse strengthening comprises at least one rib extending from the longitudinal rib to each side of the base unit for the front portion and/or for the back portion. More generally, any appropriate pattern of transverse strengthening may be employed, for example based on a triangular configuration of ribs. In one embodiment, the ribbing forms a grid pattern. This grid pattern may be square or any other appropriate shape (e.g. rectangular, triangular, hexagonal, etc). Such a grid pattern has good mechanical strength to resist distortion of the base unit.

In one embodiment, the ribbing is configured as an anti-frogging mechanism. Thus for conventional cast iron base units, it has generally been recommended that the cavities under the front and rear portions are first filled with bitumen before the base unit is installed into the road. This process is known as frogging. If a road stud is not frogged, then the cavity underneath the front and back portions is likely to remain full of air after the road stud is installed. Consequently, when a heavy vehicle passes over the road stud, the weight of the vehicle is transferred to the ground only via the outer rim of the base unit. This may interfere with the bedding of the base unit in the road, or damage the rim itself. In contrast, once a road stud has been frogged, such that the cavity is now full of road grout, then the frogged portions can also support weight directly. This then provides a better distribution of weight across the bedding of the road stud. Unfortunately however, frogging is a relatively cumbersome and hence expensive process.

Accordingly, the ribbing can be used as a form of anti-frogging mechanism that avoids having to frog the plastic base unit when installing the road stud, since the ribbing can help to transfer weight on the top of the road stud to the ground, thereby alleviating pressure on the outer rim of the base unit. In one particular embodiment, the ribbing extends all the way from the underside of the top of the front/back portion to the bottom of the base unit to ensure a good contact with the ground.

Another aspect of the invention provides a method for installing a road stud into a hole in a road. The road stud includes a base unit made of plastic. The method comprises partially filling the hole with road grout, wherein the depth of fill in the hole is less than half the height of the base unit; inserting the base unit into the hole; and then completing the filling of the hole with road grout.

Conventional cast iron base units are generally installed into a hole by first largely filling the hole with road grout, such as molten bitumen, then inserting the base unit into the hole, and then, if necessary, topping up the road grout to the desired level (too little road grout, and the road stud protrudes undesirably high above the road surface; too much road grout, and the reflectors may no longer be visible). In such an approach therefore, the majority of the road grout is pored into the hole prior to insertion of the road stud itself.

However, certain problems have been encountered when applying this conventional approach to road studs with plastic base units, not least in that the lightness of the base unit means that it may rise out of (i.e. float on) the molten bitumen. This problem can be especially acute in relation to plastic base units with ribbing configured as an anti-frogging mechanism, since as noted above, such base units retain air in the cavities underneath the front and back portions. This air can then be heated through contact with the molten bitumen at installation, which leads to increased pressure within the cavity that tries to lift the base unit out of the bitumen.

It has been found that such problems can be overcome by initially providing a much smaller depth of road grout in which to lay the base unit. It is believed that this relatively shallow layer of bitumen cools and starts to set more quickly. Consequently, when the base unit is inserted into the hole, the cooled bitumen offers much more resistance to any movement or rising of the base unit. In addition, the cooler bitumen does not heat up the air in the base unit cavities so much, thereby reducing the effective upward pressure on the base unit.

Another embodiment of the invention provides a base unit for a road stud. The base unit is made of plastic and has a front portion, a back portion, and opposing side walls. A recess for retaining a resilient insert is located between the front portion, the back portion, and the opposing side walls. A cavity is formed in the underside of each of the side walls.

The provision of a cavity in the underside of the side walls helps moulded side walls to set faster and more easily, thereby preventing possible distortion or loss of strength. There are various possible configurations for the cavity. For example, in one embodiment, the cavity in each side wall extends to the bottom of the base unit.

In some embodiments, there is at least one support structure internally bridging each cavity. Such a structure helps to maintain strength and rigidity for the base unit. In one particular embodiment, the support structure comprises one or more internal walls running from top to bottom of the cavity. These internal walls thereby divide the cavity into separate regions.

In some embodiments, each side wall has one or more projections extending over the floor of the recess for retaining the resilient insert within the recess. For each projection on a side wall, there is a corresponding support structure internally bridging the cavity formed in the side wall. The support structures are aligned with the corresponding projections. This configuration helps to provide reinforcement of the side wall where it is most subject to stress, in passing vehicles act to try to pull the resilient insert from the base unit, and this has to be resisted by the projections attached to the side walls.

Another embodiment of the invention provides a base unit for a road stud. The base unit is made of plastic and has a recess with a plurality of projections extending over the floor of the recess for retaining a resilient insert within the recess. Each of the projections is formed from one or more planar elements.

Such a configuration can be contrasted with existing base units, in which the projections for retaining the resilient insert are generally solid. In contrast, the use of planar elements for the projections provides for faster setting of moulded plastic, thereby helping to prevent distortion and/or weakness of the projections.

In some embodiments, the planar elements are arranged in a box configuration. For example, the box configuration may consist of two opposing side walls and a bottom portion, thereby forming a V-shape with a flat base. Such a configuration ensures that none of the planar elements has a protruding edge on the underside or side of the projection. This then helps to avoid any cutting of the resilient insert as a vehicle wheel passes over the resilient insert, which can lead to the wheel trying to drag the insert up and along (this force being resisted by the projections retaining the insert within the base unit).

It will be appreciated that there are a variety of possible planar configurations for the projections, such as I-beam, an inverted T-beam, a square or rectangle (optionally open on top), and so on. Note also that one or more of the planar elements may be curved, for example to form a U-shaped projection, a hollow cylindrical projection, or a semi-circular or conical projection.

Another embodiment of the invention provides a base unit for a road stud. The base unit is made of plastic and has a front portion, a back portion, and opposing side walls. A recess for retaining a resilient insert is located between the front portion, the back portion, and the opposing side walls. The top of the base unit includes an anti-skid pattern. This helps to ensure that any vehicle wheel that passes directly over a base unit does not lose traction, for example in wet weather. The anti-skid pattern may be moulded integrally with the base unit, although it might instead be formed by some other process, such as by creating an anti-slip texture on the surface of a previously made base unit. It will be appreciated that any appropriate anti-skid pattern, texture, configuration, etc may be used to cover part or all of the top surface of the base unit.

Another embodiment of the invention provides a base unit for a road stud. The base unit is made of plastic and has a front portion, a back portion, and opposing side walls. A recess for retaining a resilient insert is located between the front portion, the back portion, and the opposing side walls. The plastic of the base unit includes a colourant.

The use of a colourant can improve visibility of the road stud. This is especially the case during daylight hours, when there normally is little or no reflected light from a road stud. In some embodiments, the base unit has a luminescent colourant. This can lead to improved visibility at night, even if the road stud is not in a direct headlight beam.

The particular colour used for the road stud may impart additional information to a motorist. For example, a colour of red may indicate a line that should not be crossed, while a colour of green may indicate a line that can be crossed. The colour of the base unit may be chosen to match the colour of reflectors provided in the resilient insert of the road stud. Alternatively, the base unit and the reflectors might be arranged to have contrasting colours in order to enhance visibility or distinctiveness. The resilient insert itself may also be coloured, for example to match or to contrast with the base unit and/or the reflectors, depending upon the particular circumstances.

A plastic base unit as described herein may have various features, such as one or more fitted portions, transverse strengthening, a cavity in the side walls, projections made of planar elements, a colourant included in the plastic, and an anti-skid pattern. It will be appreciated that any given plastic base unit may incorporate a combination of any one or more of the features described herein, depending upon the particular needs and requirements of a given situation.

A plastic base unit is very lightweight compared to existing cast iron base units, thereby helping with transport, working and general machine operations, such as road installation. For example, such a plastic base unit might be dispensed by machine from a cassette of base units, thereby offering faster, safer, and more controlled, automatic installation.

BRIEF DESCRIPTION OF THE DRAWINGS

Various embodiments of the invention will now be described in detail by way of example only with reference to the following drawings.

DETAILED DESCRIPTION

Figure 1:
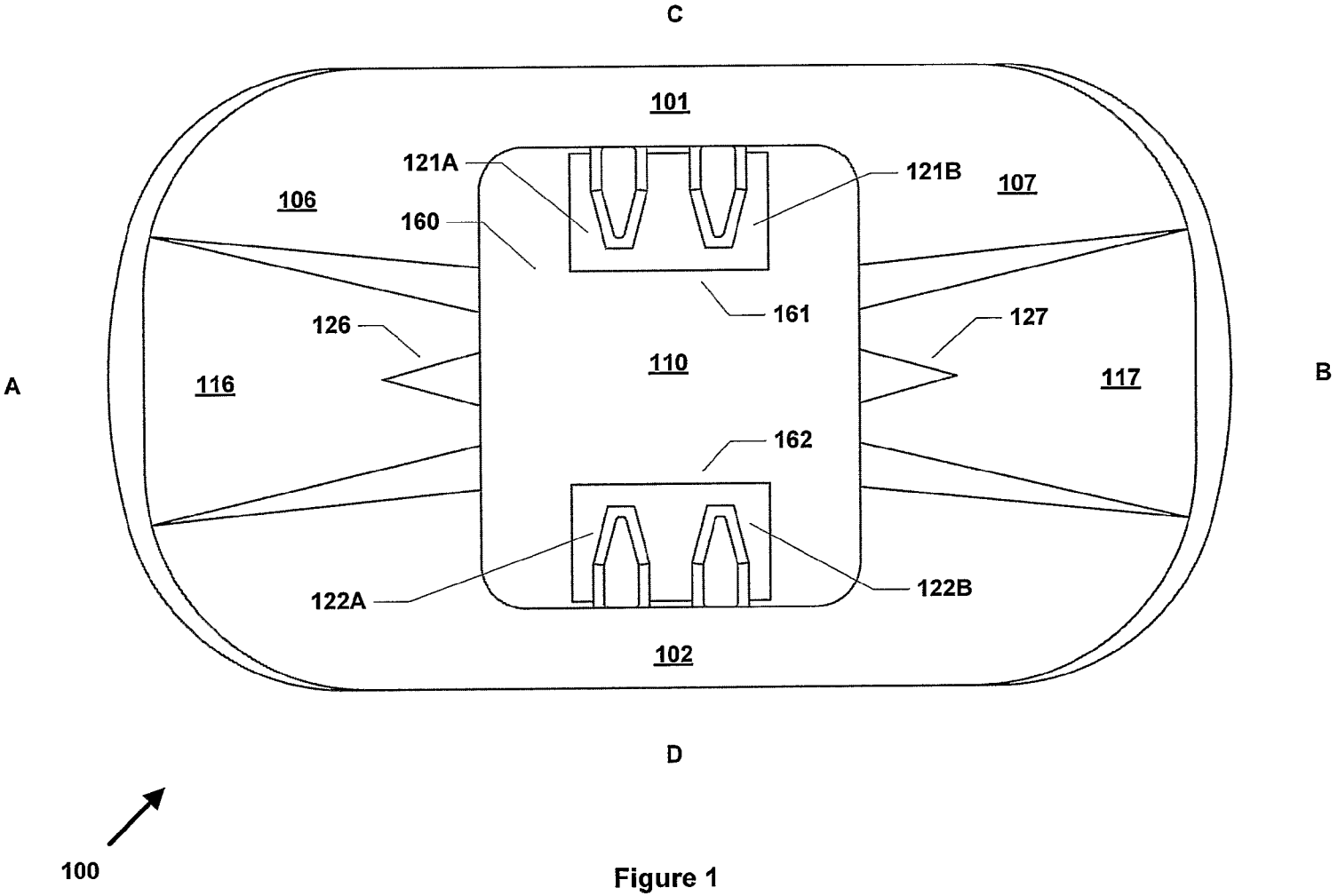
FIG. 1 is a plan view of a plastic base unit for a road stud in accordance with one embodiment of the invention.

FIG. 1 illustrates a base unit 100 for a road stud in accordance with one embodiment of the invention. The base unit is designed to receive a depressible insert having one or more reflectors. The base unit 100 is compatible with existing base units and inserts, such as described in GB 2263298—in other words, base unit 100 accepts inserts made for existing base units. However, base unit 100 is made of a plastic material such as nylon or a polycarbonate, for example by injection moulding, in contrast to the cast iron base unit of existing road studs. The plastic base unit 100 has a weight of approximately 500 g, and is therefore very substantially lighter than existing cast iron base units.

FIG. 1 shows a plan view of the base unit 100. For convenience of explanation, the front of the base unit (as perceived by an oncoming motorist) is indicated by the location of letter A, the rear of the base unit by the letter B, and the sides by the letters C and D. It will be appreciated nevertheless that the base unit of FIG. 1 is symmetric, so that alternatively B could be considered as the front and A as the rear. This symmetry supports bi-directional operations, for example if the road stud is to be fitted down a central line of a single carriage-way, in which case the insert can incorporate reflectors for both directions (forwards and backwards). In other locations, such as to demarcate lanes within one carriage-way of a motorway, the insert only needs to be provided with reflectors (or a reflector) facing in the forwards direction, i.e. towards oncoming traffic.

The main body of the base unit 100 includes side walls 101 and 102, front portion 106 and rear portion 107. When the base unit 100 is installed in the road, the top surface of front and rear portions 106 and 107 and also of side walls 101 and 102 protrudes slightly above the road surface. The base unit further includes a recess 110 defined between side walls 101 and 102, which is used to receive the depressible insert. Each side wall includes a pair of projections 121A, 121B, and 122A, 122B that extend into recess 110. The projections 121, 122 are used to retain the resilient insert within recess 110. The insert is sized so that when held in recess 110, it protrudes slightly above the top surface of the base unit 100. As a result, the insert is compressed by any vehicle wheel that passes directly over the road stud, thereby activating the wiper blades within the insert to clean the reflectors (as described in GB 2263298 B).

The front portion 106 of the base unit 100 is formed with a channel 116 that slopes down towards recess 110. The channel 116 helps to provide a clear line of sight to the reflector(s) located on the insert within recess 110. In addition, the channel 116 also helps rainwater to run into recess 110, where it can collect for use in cleaning and lubricating the reflector(s) (as described in GB 2263298).

Base unit 110 is intended for use with an insert having two reflectors facing forwards. The final portion of channel 116 is therefore bifurcated by ridge 126, which provides one sub-channel for each reflector. Note that ridge 126 also helps to direct rainwater to corresponding ducts in the insert that communicate with the bottom of recess 110, where rainwater can accumulate (such ducts are also described in GB 2263298).

The rear portion 107 of the base unit is shaped in the same manner as the front portion 106. In particular, rear portion includes channel 117, which is bifurcated by ridge 127. It will be recognised by the skilled person that the shape of base unit 100 as so far described corresponds generally to the shape of existing base units made of cast iron, thereby ensuring compatibility with such existing base units.

Figure 2:
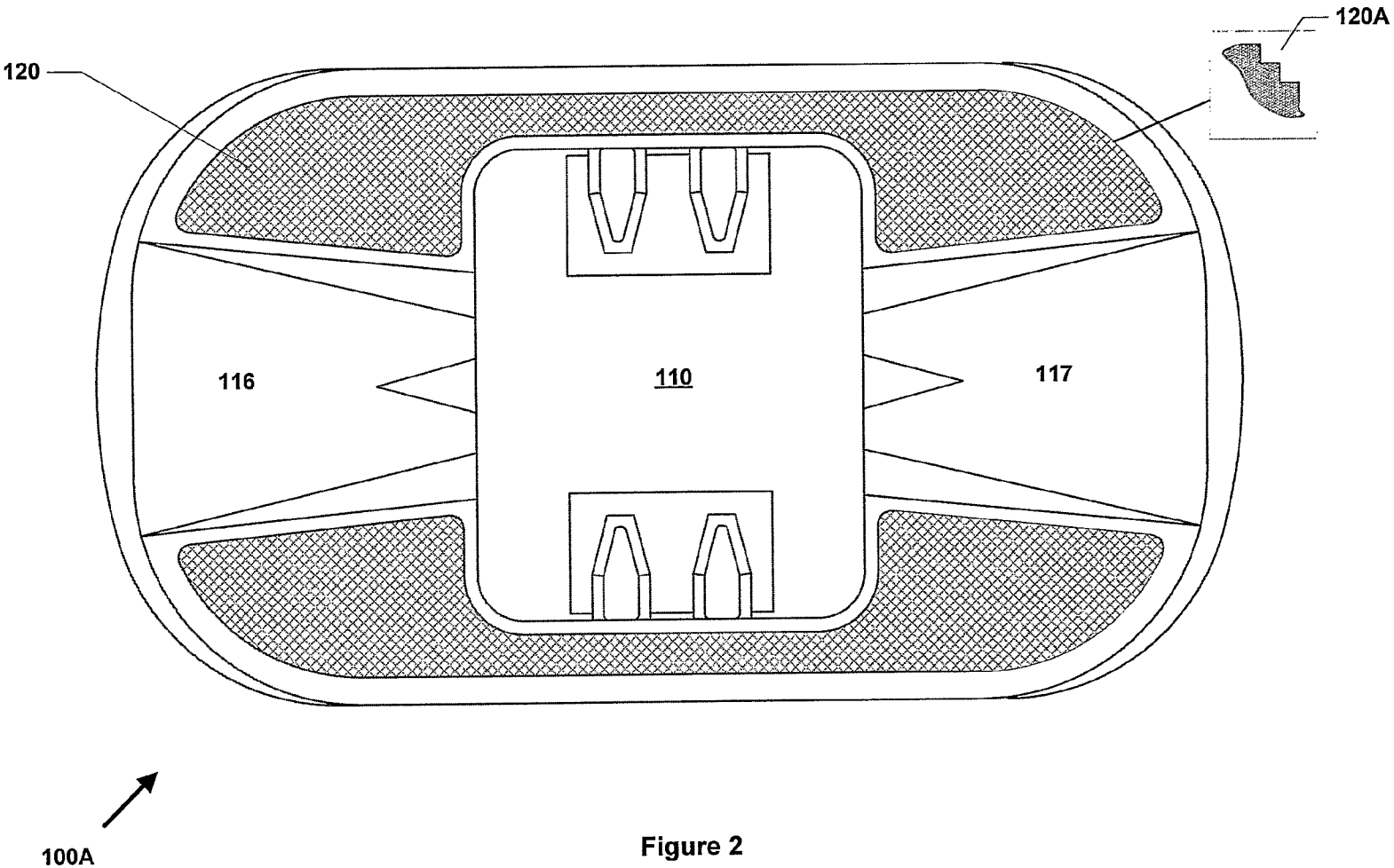
FIG. 2 depicts an alternative embodiment of the base unit of FIG. 1, in particular having an anti-skid pattern on the surface of the base unit.

FIG. 2 shows a plan view of a base unit 100A similar to the base unit of FIG. 1. In this embodiment the top surface of base unit 100A is provided with an anti-skid or anti-slip pattern 120. The insert 120A shows a small section through this pattern to indicate in profile the surface texture of anti-skid pattern 120. The anti-skid pattern 120 helps to ensure that when a vehicle wheel crosses the top surface of base unit 100A protruding from the road, the wheel does not suddenly lose traction or start to skid. Note that existing base units are not provided with such an anti-skid pattern 120.

The particular anti-skid pattern 120 shown in FIG. 2 comprises a diamond configuration, but the skilled person will appreciate that any suitable anti-skid configuration or texture could be used for this top surface. In addition, the anti-skid pattern 120 of FIG. 2 is shown extending across the whole top surface of the base unit 100A, in other words, everywhere except for recess 110 and channels 116 and 117. The skilled person will appreciate that in other embodiments, the anti-skid pattern(s) may be provided only on a portion (or portions) of this top surface.

Returning to FIG. 1, it will be noted that the floor 160 of recess 110 comprises two openings or apertures 161, 162. Aperture 161 extends from side wall 101 towards the centre of recess 110, while aperture 162 extends from side wall 102 towards the centre of recess 110. The size of each aperture is sufficiently large to encompass the projections formed on the corresponding side wall. In other words, opening 161 extends at least as far into recess 110 as projections 121A and 121B, while opening 162 extends at least as far into recess 110 as projections 122A and 122B.

Base unit 100 may be manufactured using injection moulding (the injection point would typically be in the centre of floor 160). In such a process, apertures 161 and 162 allow base unit 100 to be withdrawn from the mould. In particular, apertures 161 and 162 avoid the mould becoming in effect locked between the floor 160 of the recess and projections 121, 122 (it is of course the intention of the projections 121, 122 to hold a resilient insert in this manner).

Prior to use of base unit 100, apertures 161, 162 are closed by respective inserts, so that floor 160 in effect extends the full width of recess 110, from side wall 101 to side wall 102. This then ensures that recess 110 can retain rainwater for cleaning and lubrication purposes. In addition, closing apertures 161 and 162 also prevents any material from the underlying road, for example grit or bitumen, from entering recess 110 from below the base unit (any such material would then contaminate the rainwater, and so degrade the cleansing action of the insert wiper blades).

In general the inserts can be formed from the same plastic material as the rest of base unit 100, although in some embodiments a different material may be used. The number of inserts to be used corresponds to the number of openings. For example, the embodiment of FIG. 1 has two inserts, but other embodiments may use a different number of inserts (as discussed in more detail below). The insert(s) can be fixed into the corresponding opening(s) by any suitable technique, for example adhesive bonding, acoustic welding, some form of snap or press fit, an interference fit, and so on.

In one embodiment, the size of the opening(s) 161, 162 is greater (in at least one dimension) when viewed from the bottom of floor 160 than from the top of floor 160. This can be seen in FIG. 3, which represents an underneath view of base unit 100. Note that aperture 161 has an outer perimeter 181A, as defined in the underside of floor 160, and an inner (smaller) perimeter 181B, as defined in the topside of floor 160. Aperture 162 is similarly shaped. In order to accommodate this change in aperture perimeter, the floor wall defining apertures 161 and 162 may be slanted or stepped (or a combination of both) for at least a portion of the aperture perimeter.

The provision of a slanted or stepped wall to define an aperture allows an insert to be located more securely in the aperture. In particular, the smaller perimeter 181B on the top side of the floor prevents an insert from passing completely through the aperture, and also allows an insert to be pressed more firmly into the aperture during fitting, for example for a snap fit. In addition, the slanted or stepped wall provides a greater contact area between the insert and the aperture wall for better bonding (whether by adhesive or any other form of bonding). The skilled person will appreciate that various additional profiles (other than stepped or slanted) could also be used for the aperture wall. For example, the aperture wall might be provided with a curved ridge and/or recess to help locate and retain an insert in the correct position with respect to the base unit.

Note that in some embodiments, an aperture may have a greater perimeter on the top side of the floor 160 than on the bottom side. This would normally imply insertion from the top of the floor 160, i.e. from within recess 110. In contrast, having a smaller perimeter on the top side of the floor allows placement of the insert from underneath the base unit, which is generally more convenient, since it avoids possible obstruction by projections 121, 122.

Figure 3:
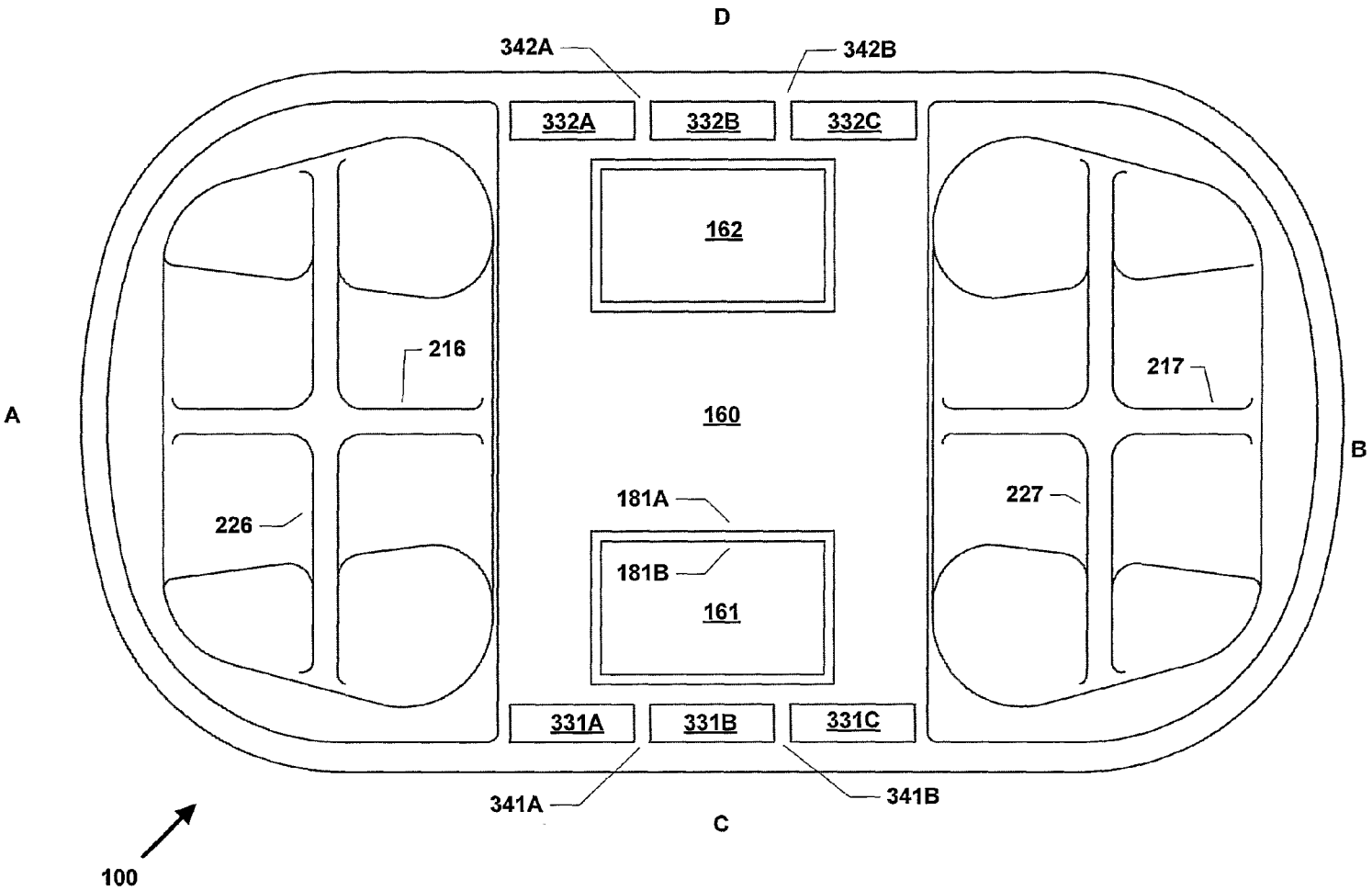
FIG. 3 represents a view of the base unit of FIG. 1 from underneath in accordance with one embodiment of the invention.
Figure 4B:
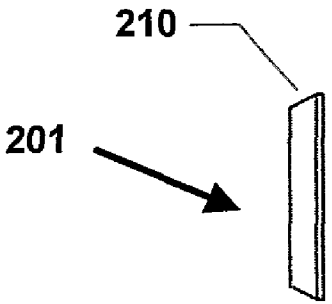
FIGS. 4A and 4B represent a plan view and section respectively of a plastic insert for fitting into the base unit of FIG. 1 in accordance with one embodiment of the invention.
Figure 4A:
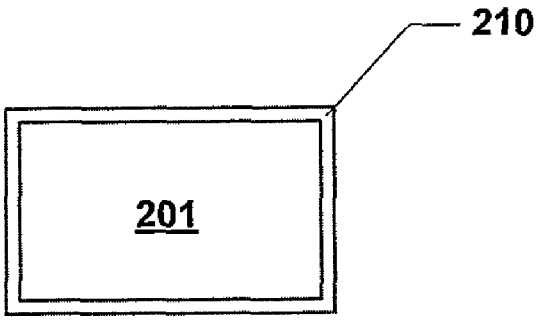

FIG. 4A illustrates a plan view of an insert 201 for use with the base unit of FIG. 3. FIG. 4B represents a section through the insert of FIG. 4A. Note that the side walls 210 of the insert are slanting (with respect to the top and bottom surfaces of the insert). Insert 210 is intended to fit into a correspondingly designed aperture within base unit 100, for example where aperture 161 has walls slanting from inner perimeter 181B to outer perimeter 181A.

The skilled person will appreciate that other configurations may be used for the aperture or apertures placed in the floor of recess 160, dependent in part upon the number and location of projections 121, 122 (which may not necessarily be the same as shown in FIG. 1). For example, one possibility would be to define a separate opening for each projection. This would then lead to four openings for the four projections shown in FIG. 1, with each of openings 161, 162 in effect being split in half. Another possibility is that the base unit contains only a single aperture that extends across the width of the base unit from side wall 101 to side wall 102. In this embodiment, the single aperture encompasses all the projections (four in FIG. 1), again permitting removal from an injection mould. (Such an embodiment may use front portion 106 and rear portion 107 as twin injection points).

Figure 5:
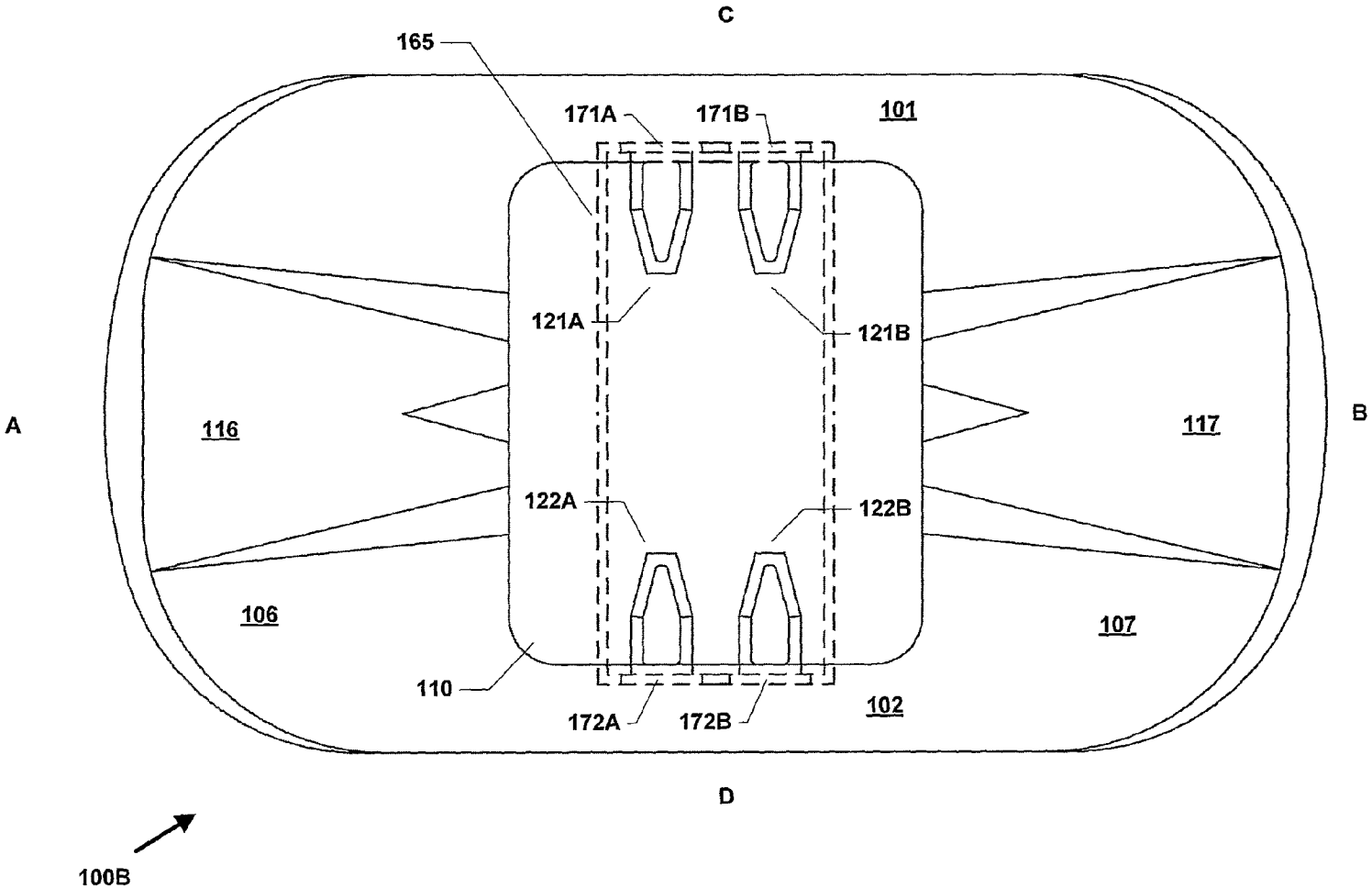
FIG. 5 is a plan view of a plastic base unit for a road stud in accordance with another embodiment of the invention.
Figure 6:
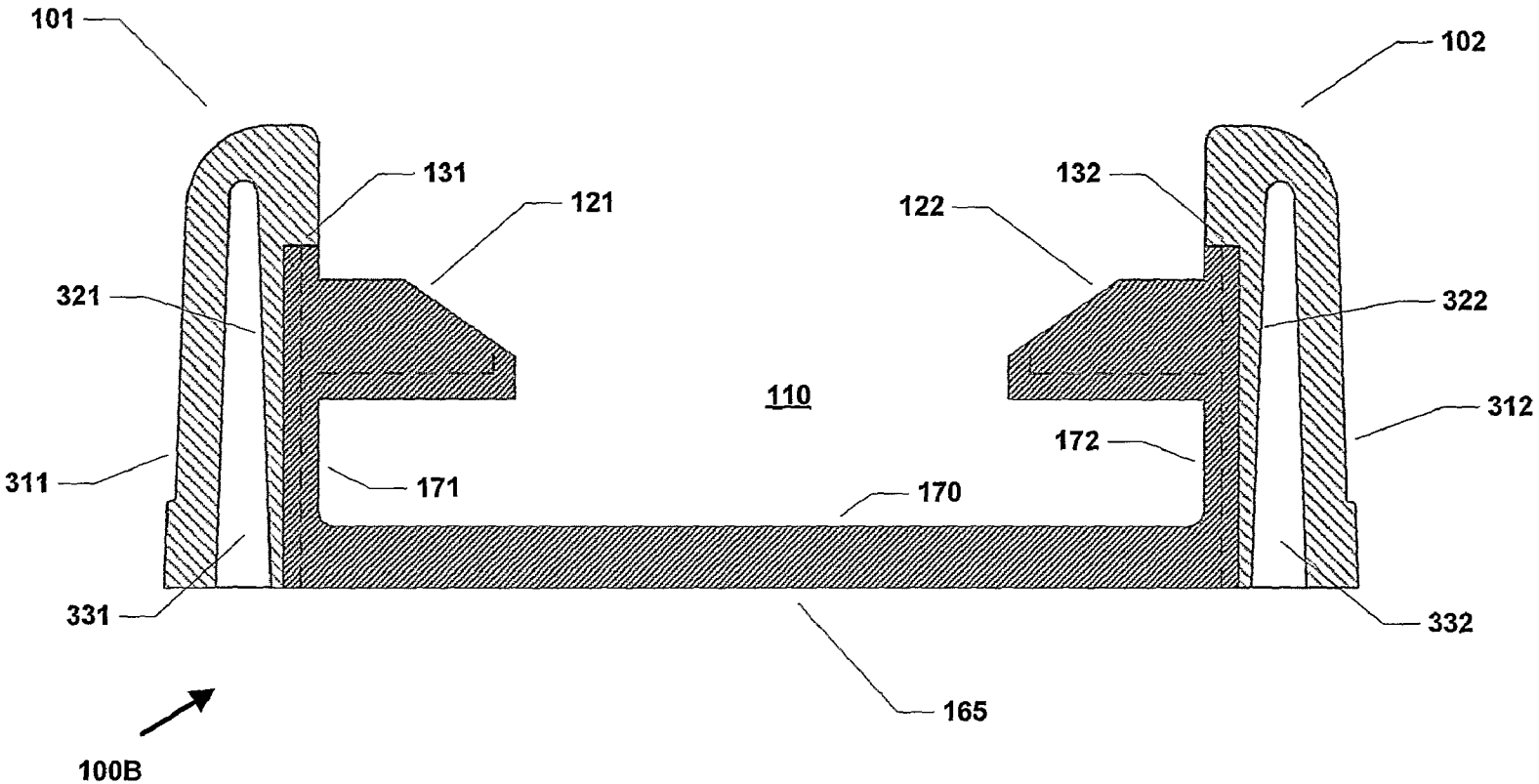
FIG. 6 is a transverse section through the centre of the base unit of FIG. 5.
Figure 7:
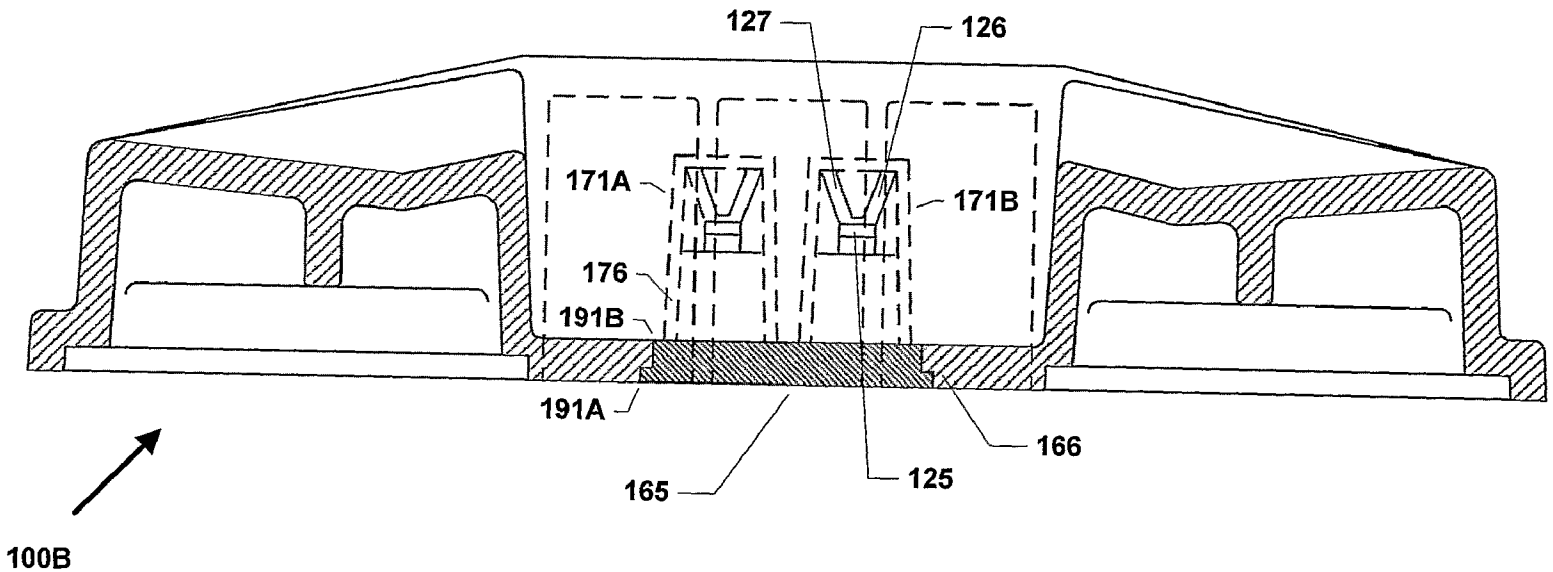
FIG. 7 is a longitudinal section through the centre of the base unit of FIG. 5.

FIGS. 5, 6 and 7 illustrate a plan view of a base unit 100B in accordance with another embodiment of the invention. Base unit 100B is generally similar to base unit 100 of FIG. 1, but instead of having two apertures 161, 162 in the floor 160 of recess 110 for receiving respective planar inserts, in this embodiment the base unit 100B receives a single insert 165. This insert includes a floor portion 170 and opposing side walls 171, 172 that support projections 121, 122 (see in particular FIG. 6). Therefore, in this embodiment, the projections are not directly attached to the body of the base unit, but rather are formed as part of the insert 165 for locating into the base unit. Insert 165 is generally made of plastic, as for the rest of base unit 100B. However, it will be appreciated that the skilled person will be aware of further possible configurations and materials for the insert 165.

In the embodiment illustrated in FIGS. 5, 6 and 7, the floor 160 of the recess 110 is initially formed with an opening extending from one side wall 101 to the other side wall 102. The insert 165 is then located into the base unit through this opening from underneath the base unit. Note that it is important that insert 165 is securely held within base unit 100B. This is because the force of passing vehicles on the resilient insert carrying the reflector(s) is transferred to the insert 165 via projections 121, 122, which in turn try to lift insert 165 from base unit 100B. Accordingly, as shown in FIG. 7, the floor opening is formed with a step 166 between the inner perimeter 191B and the outer perimeter 191A, so that the perimeter 191A on the underside of floor 160 is greater than the perimeter 191B on the topside of floor 191B. The insert 165 has a corresponding shape, and can therefore be more securely located with respect to the base unit 100B. It will be appreciated that other embodiments may use a curved or slanting wall for the opening and insert (such as shown in FIG. 4B), rather than step 166.

For ease of insertion, step 166 is only located along the two opposing edges of the insert floor 170 that do not support side walls 171, 172 and their projections. However, as shown in FIG. 6, the side walls 101 and 102 of base unit 100B are formed with respective ledges 131 and 132 that engage with the tops of insert side walls 171 and 172 respectively, and these ledges also help to retain insert 165 within the base unit 100B.

In another embodiment (not illustrated), insert 165 may be designed for insertion from the top of the base unit rather than from the bottom of the base unit. In this case, the floor 160 of the base unit may be complete (i.e. formed initially without any opening), with insert 165 then being installed on top of this floor. In this case, ledges 131 and 132 may still be used to retain the insert 165 within the base unit. For example, during insertion, side walls 171 and 172 may be slightly compressed towards one another. Once the insert 165 is properly positioned, the side walls can then be released to spring out into engagement with ledges 131 and 132, thereby locking insert 165 into position.

In the particular embodiment illustrated in FIGS. 5, 6 and 7, each projection is supported by its own side wall. Therefore, with two projections on each side of the recess, side walls 171 and 172 each comprise two separate side walls. In other words, projection 121A is supported by side wall 171A and projection 121B is supported by side wall 171B, while projection 122A is supported by side wall 172A, and projection 122B is supported by side wall 172B (see FIG. 5). It will be appreciated that in other embodiments however, two or more projections may be supported on the same side wall.

In the embodiment illustrated in FIG. 7, side walls 171A and 171B are each provided with a lip or step 176. As the insert 165 is inserted into base unit 100B, the insert side walls 171A and 171B are received into corresponding slots in base unit side wall 101. These slots have a counterpart shape to lip 176, so that side walls 171A, 171B have a greater width deeper into side wall 101. This configuration then acts to retain the insert side walls 171A, 171B with the side wall 101 of the base unit, even if projections 121A, 121B experience a pull towards the centre of recess 110. It will be appreciated that this configuration is therefore broadly analogous to the step 166 shown in FIG. 7 for retaining the insert 165 in the floor of the base unit. Note also that a corresponding arrangement is provided for retaining the side walls 172A, 172B of insert 165 within base unit side wall 102.

Returning to FIG. 3, it is noted that the undersides of front portion 106 and rear portion 107 are at least partly excavated or hollowed to reduce weight. Existing cast iron base units have a generally similar excavation. Although such cast iron base units are inherently very strong, they may become slightly brittle, and hence may crack in response to an impact. The most plausible direction for such an impact is longitudinal, in other words parallel to the flow of traffic, when a passing vehicle strikes the road stud. Therefore many existing cast iron road studs have a longitudinal ribbing in the excavated underside of the base unit front and rear portions to brace against this type of impact.

A plastic base unit such as shown in FIG. 3 needs to withstand not only fracture but also flexure, otherwise the weight of a vehicle passing over base unit 100 (for example) may distort the shape of the base unit. Accordingly, the underside of the front portion 106 of base unit 100 is provided with both longitudinal ribbing 216 and also lateral (transverse) ribbing 226. This ribbing helps to prevent distortion of the base unit 100, and may act in compression or tension, depending upon the type of distortion involved. In particular, the transverse ribbing 226 provides reinforcement against lateral distortion of the base unit 100. The same pattern of longitudinal and transverse ribbing 217, 227 is also provided in the excavated region underneath the rear surface 107 of the base unit.

It will be appreciated that the precise pattern and configuration of ribbing to protect against distortion may vary from one embodiment to another. For example, although the embodiment shown in FIG. 3 has only a single transverse ribbing, in other embodiments there may be multiple such transverse ribbings. In addition, although the ribbing in FIG. 3 is aligned either laterally or longitudinally, in other embodiments a diagonal, triangular or curved configuration of ribbing might be employed (either in conjunction with or instead of the longitudinal and lateral ribbing shown in FIG. 3).

Figure 3A:
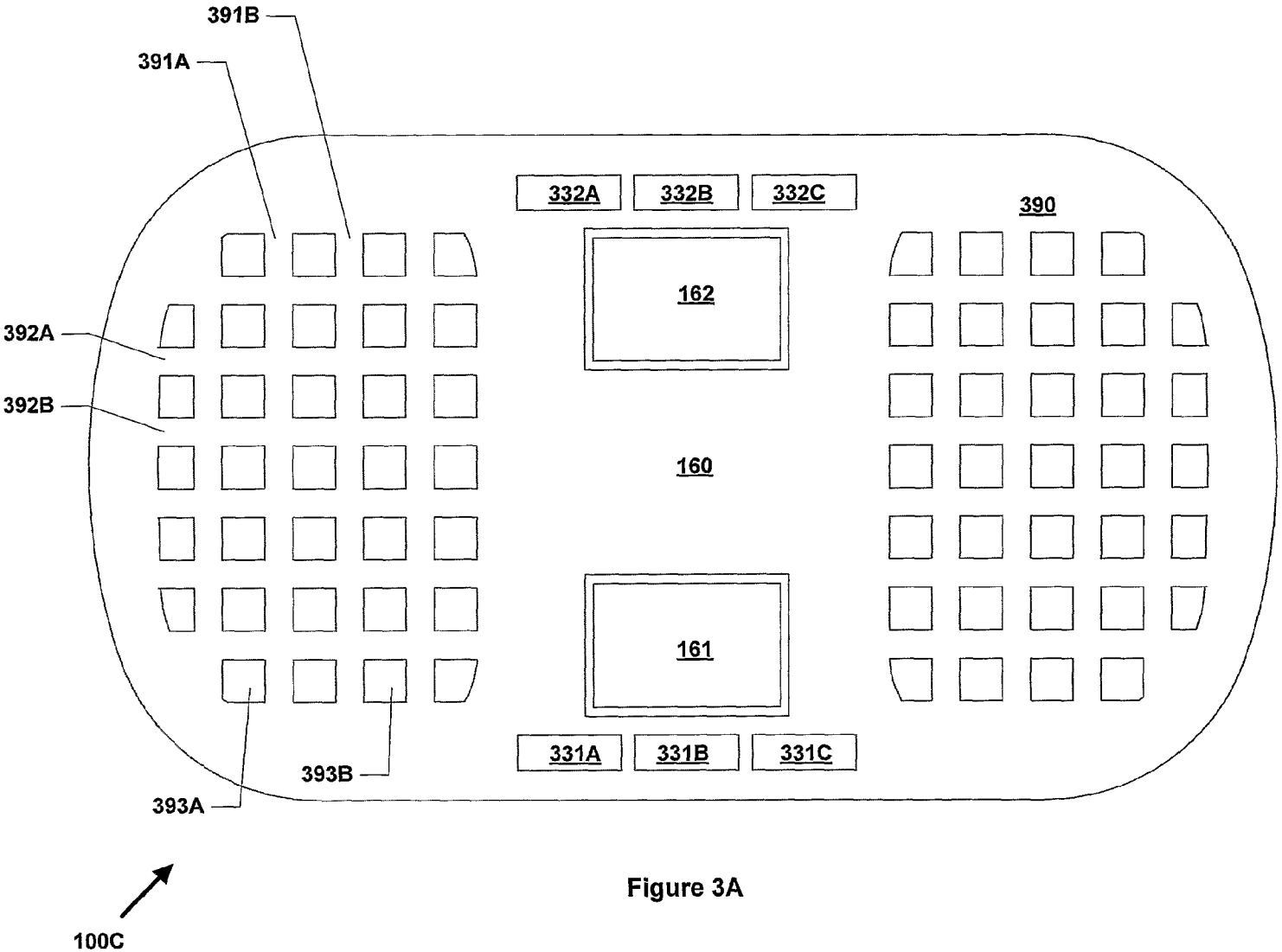
FIG. 3A represents a view of a base unit from underneath in accordance with another embodiment of the invention.

FIG. 3A illustrates a base unit 100C. in accordance with another embodiment of the invention. The base unit 100C of FIG. 3A has a different pattern of ribbing from the base unit 100 shown in FIG. 3. It will be appreciated that the pattern of ribbing shown in FIG. 3A may be used in any other appropriate embodiment, for example, in the embodiment shown in FIG. 2 or 5, etc.

The embodiment of FIG. 3A has ribbing arranged in a grid pattern 390. In particular, the grid is defined by multiple transverse ribs or walls 391A, 391B that span the width of the base unit and by multiple longitudinal ribs or walls 392A, 392B. These walls break down the cavity underneath the front portion of the base unit into spaces 393A, 393B, etc (likewise for the cavity underneath the rear portion of the base unit). Ribbing 391, 392 extends from the top of the base unit down to the bottom of the base unit (i.e. flush with floor 160). Ribbing 391, 392 strengthens the base unit 100C as previously described. In addition, ribbing 391, 392 provides greater contact of the base unit with the road grout during installation, thereby helping to hold the base unit in position.

One particular advantage of the ribbing of the embodiment of FIG. 3A is in relation to frogging. Frogging is a process whereby conventional metal base units have the cavities underneath the front and back portions filled with road grout prior to installation. Frogging in this manner ensures that after installation, the front and back portions can transfer weight from passing vehicles through the road grout in the cavities to the ground. In contrast, in the absence of frogging, the cavities would be full of air, and so could not transfer weight in this manner. This would then concentrate any passing weight onto the rim of the base unit, with potential consequential damage for the bedding of the base unit in the road and/or the rim of the base unit itself. However, frogging is a relatively time-consuming and therefore expensive operation.

The ribbing shown in FIG. 3A is configured to avoid frogging. In particular, since the walls 391, 382 extend down to the floor of the base unit from the top surface of the front and rear portions, these walls can transfer weight from the top of the base unit to the ground. The grid pattern distributes any such weight widely across the underneath of the base unit, and so reduces the risk of any damage to the bedding of the road stud in the road (or to the road stud itself).

The grid pattern 390 shown in FIG. 3A is substantially square in shape, with a repeat distance of approximately 1.5 cm. This repeat distance allows the walls 391, 392 to be thick enough for good strength, and also frequent enough for a good weight distribution. Other embodiments may use other shapes and/or sizes for the grid. For example, the grid may be based on triangle or hexagons, or on some combination of shapes. Frogging may also be avoided with other patterns of ribbing (not necessarily a grid), for example a number of parallel ribs, whether longitudinal, transverse or diagonal.

(Note that frogging could also be avoided by having the front and back portions of the base unit solid—i.e. without cavities underneath. However, this would increase the weight of the unit, a particular problem for conventional cast iron base units, and would make moulding a plastic base unit much more difficult).

Although the lack of frogging potentially allows quicker installation of the base units 100, another problem sometimes arises from the reduced weight of the plastic base units. Thus the conventional approach for installing a road stud is to create a hole in the road, fill the hole with molten bitumen or other road grout, and then insert the base unit into the road. With this approach, it may be necessary after inserting the base unit into the road to top up the hole with road grout to ensure as smooth a road surface as possible around the road stud.

However, if this approach is adopted with plastic base units, there is a risk of the relatively light base unit rising to float on top of the (molten) road grout. This risk is exacerbated where an anti-frogging configuration is used, for example, in the embodiment of FIG. 3A. In such an embodiment, air is retained in the spaces 393A, 393B between the ribbing. At installation time, this air is heated by contact with the molten bitumen in the road hole. As a result, the heated air tries to expand, and this in turn acts to lift the base unit 100C out of the road hole.

It has been found that such problems can be circumvented by a different approach to installation, in which the road hole is initially filled with a relatively shallow layer of road grout, and then the base unit is installed. (The resilient insert may already be inside the base unit at installation, or may be inserted subsequently). Once the base unit is located in the relatively shallow layer of road grout, which may perhaps cover less than half the depth the road stud (e.g. a depth of about 1-2 cm), further road grout is poured into the hole in order to fill the hole as required. It has been found that this approach generally overcomes the tendency for the plastic base unit to rise or float during installation. This is believed to be due to the fact that the shallow layer of molten bitumen cools relatively quickly (compared to a deeper layer). One consequence of this is that the air in the cavities underneath the front and rear portions of the base unit is not heated so much, thereby reducing any lifting tendency. A second consequence is that the bitumen starts to set and so become more viscous. This increased viscosity tends to resists any upwards movement of the base unit, thereby helping to ensure that the base unit is installed to the correct depth in the road.

FIGS. 3 and 3A also shows that side walls 101 and 102 are hollowed out. This hollow region extends from the underside of base unit 100 up into the side walls 101, 102, and can be seen more clearly in the cross-section of FIG. 6. In particular, side wall 101 can be seen to comprise an outer portion 311 and an inner portion 321 with a cavity 331 in between. The outer portion 311 of the side wall defines the external side surface of the base unit, while the inner portion of the side wall defines the recess 110 for receiving an insert. The cavity 331 is open at the bottom of the base unit, and extends upwards, until it is closed off at the top by the top surface of side wall 101, which bridges the inner portion 321 to the outer portion 311. The provision of cavity 331 lightens the base unit 100, and also helps manufacture, by avoiding large solid volumes that might set slowly (or improperly) when using injection moulding. Note that side wall 102 is similarly structured, with outer portion 312, inner portion 322, and a cavity 332 in between.

In one embodiment, cavity 331 is spanned by two cross-walls 341A and 341B (see FIG. 3). These cross-walls span from the outer portion 311 of the side wall to the inner portion 321, and extend the full height of the side wall, thereby dividing cavity 331 into three separate regions, denoted 331A, 331B, 331C. Cavity 332 is likewise spanned by two cross-walls 342A and 342B, which divide cavity 332 into regions 332A, 332B, 332C.

The cross-walls 341, 342 strengthen the base unit against possible distortion or flexure due to the presence of the cavities 331, 332. Note that the cross-walls are generally aligned with the projections 121, 122. In other words, cross-wall 341A is attached to inner portion 321 directly opposite projection 121A, and cross-wall 341B is attached to the inner portion 321 directly opposite projection 121B (likewise for cross-walls 342A and 342B and projections 122A and 122B respectively). This configuration reflects the fact that in operation, the projections 121, 122 resist movement of the resilient insert in response to traffic passing over the road stud. Cross-walls 341, 342 in turn help to ensure that the resulting forces imparted to the projections 121, 122, do not distort the inner portions 321, 322 of the side walls 101, 102. Rather, the cross-walls brace the inner portions 321, 322 to maintain the proper shape and orientation of the side walls, which in turn support the projections to retain the resilient insert within the base unit.

It will be appreciated that in other embodiments, the number, configuration and/or shape of the cross-walls may vary from that shown in FIG. 3. For example, some embodiments may use more or fewer cross-walls for each side wall than the two cross-walls shown in FIG. 3. Likewise, rather than having straight, vertical cross-walls, such as shown in FIG. 3, the cross-walls may be slanted, curved, or have any other appropriate shape. In addition, the cross-walls may only extend for part of the height of cavity 331. Furthermore, rather than using cross-walls, the side wall may have any other appropriate form of support or reinforcement bridging the cavity, such as one or more posts.

Looking now at FIGS. 6 and 7, projections 121, 122 have an overall shape that is generally similar to the projections on existing cast iron base units. However, the projections on existing cast iron base units are solid, whereas projections 121, 122 have a box or hollowed configuration. The use of a box configuration lightens the projections, and helps manufacturing by reducing the time required for the injection moulding to set (a long setting time may lead to distortion and/or weakness). At the same time, the box profile for projections 121, 122 helps to ensure that the projections are strong enough to retain the resilient insert within the base unit.

In one embodiment, each projection comprises two side walls 126, 127 attached to a floor 125, where both side walls and the floor extend perpendicularly from the side wall 101, 102 of the base unit. The portion of the projection furthest from the side wall 101, 102 is tapered to reduce the height of the projection, as can be seen best in FIG. 6. This tapering helps the projection to mate with a corresponding hole in the resilient insert. The end of the projection furthest from the side wall of the base unit may be provided with a lip, again as shown in FIG. 6. The top surface of the projection is open. Overall, the projection has a generally V-shaped cross-section when viewed in a plane parallel to the side walls of the base unit (and hence perpendicular to the direction of protrusion of the projection), although the base 125 of the V is flat rather than pointed (as shown in FIG. 7).

The projections 121, 122 act to retain a resilient insert within base unit 100. In particular, as a vehicle wheel passes over the insert, the traction between the wheel and the resilient insert may try to pull the insert from the base unit. Accordingly, projections 121, 122 are primarily intended to resist upward and sideways motion of the resilient insert. (In contrast, compression of the resilient insert into the base unit is limited, since once the resilient insert has been pushed down below the top surface of the base unit, it is generally protected by the base unit against further compression).

The provision of a flat-based V-shaped cross-section for the projections 121, 122 ensures that any upwards or sideways motion of the insert is resisted by the full face of a wall of the projections. In particular, upwards motion of the insert is resisted by the flat base 125 of the projections, while sideways motion is resisted by the side walls 126, 127 of the projections. This then avoids any tendency for a projection to cut into the insert (any such cutting action might ultimately cause a split in the resilient insert, after which the insert could no longer be securely retained in the base unit).

Figure 8:
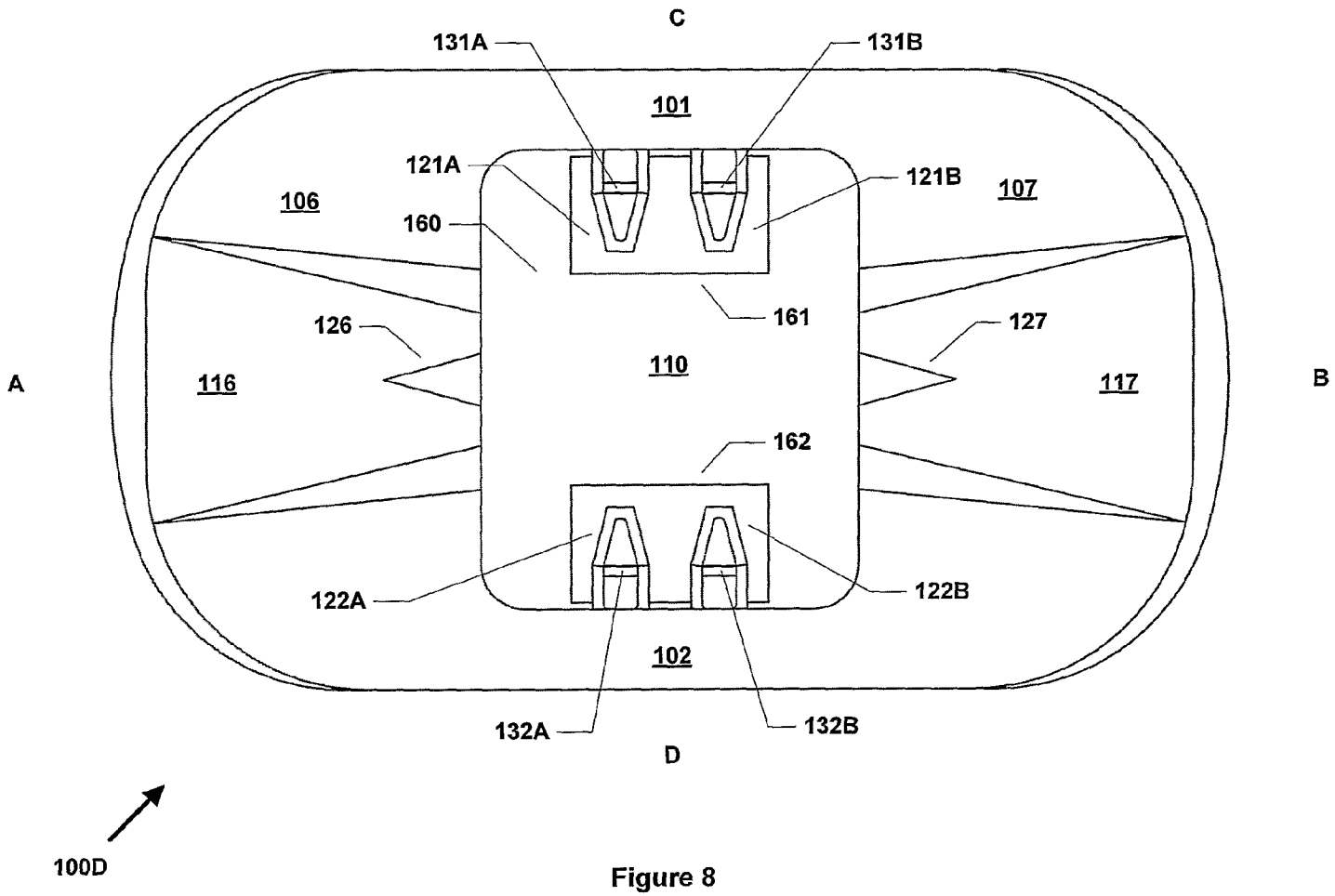
FIG. 8 is a plan view of a plastic base unit for a road stud in accordance with another embodiment of the invention.

FIG. 8 illustrates an alternative embodiment of base unit 100D. In the embodiment of FIG. 8, each projection is provided with a cross-wall for strengthening purposes. In particular, projection 121A is provided with wall 131A, projection 121B is provided with wall 131B, projection 122A is provided with wall 132A, and projection 122B is provided with wall 132B. These walls 131, 132 run perpendicular to the direction of the extension from side walls 101, 102, and are located approximately half-way along their respective projection (measuring out from the side wall). Walls 131, 132 extend the height of the projection and counter any flexing or distortion of the projections, thereby helping to retain an insert within base unit 100D.

Although FIGS. 1-8 depict one particular shape for projections 121, 122, it will be appreciated that many other different shapes or configurations might be used instead. For example, rather than having a flat-based V-shaped cross-section, other cross-sections might be employed, such as O-shaped, square, U-shaped, oval, rectangular, triangular, semi-circular, and so on. Other cross-sectional shapes, such as I or H or T, might also be used, if the insert is robust against any possible cutting (or can be suitably protected, such as by the use of rounded edges on the projection). In addition, the tapered form of the projection, such as shown in FIG. 7, may be varied as appropriate for other embodiments.

Figure 9:
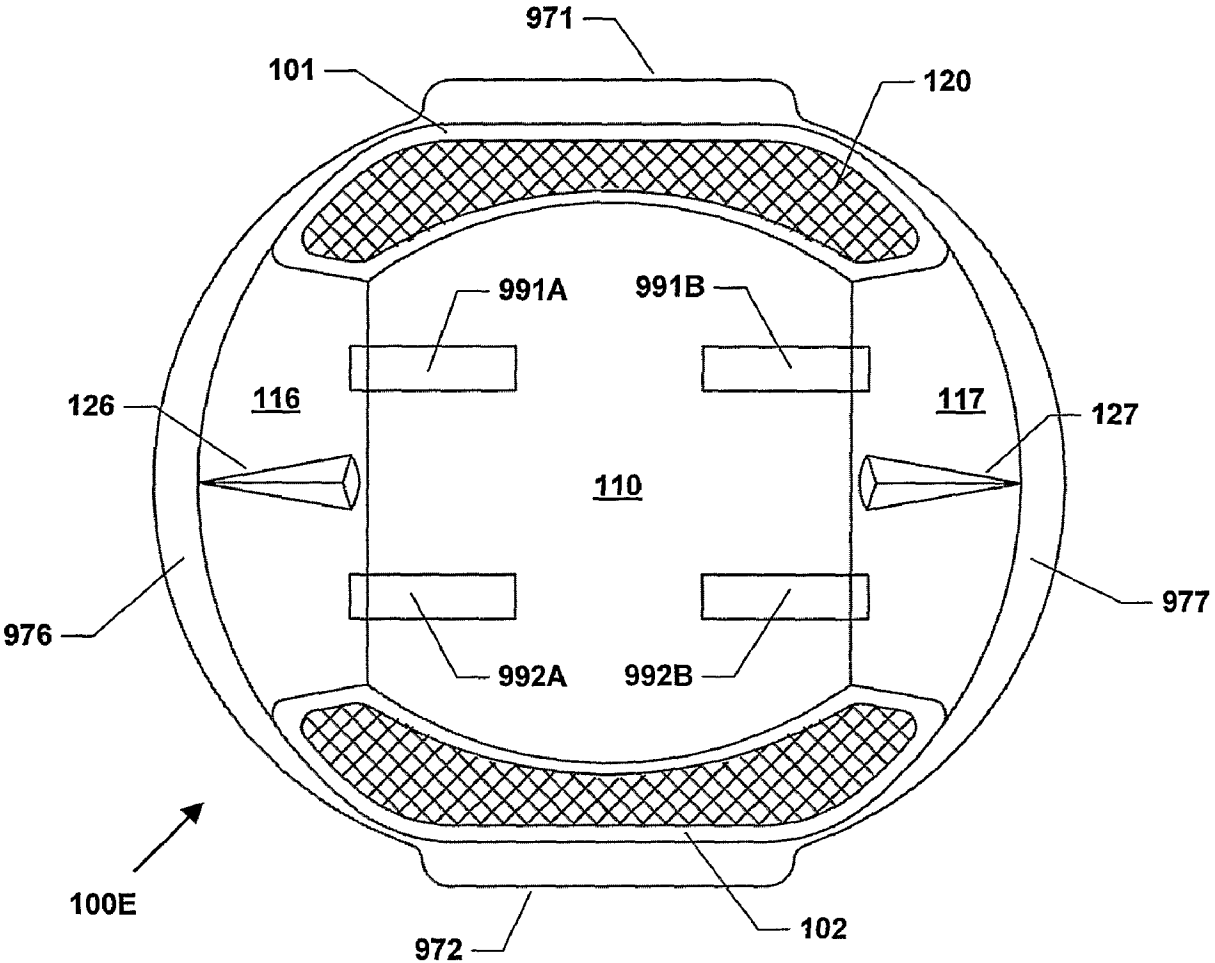
FIG. 9 is a plan view of a plastic base unit for a road stud in accordance with another embodiment of the invention.
Figure 10:
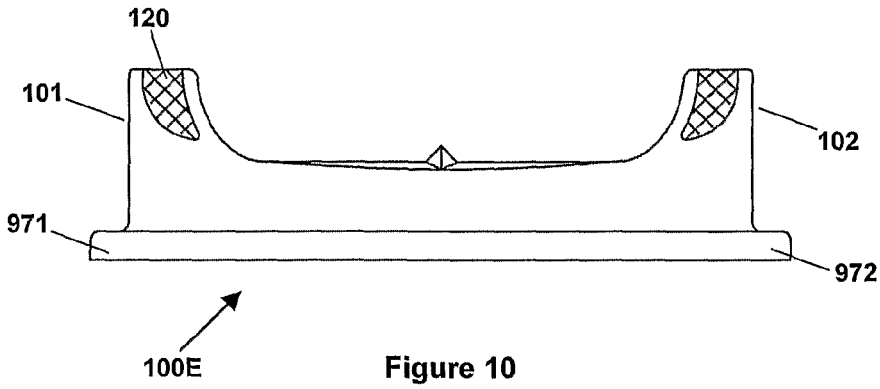
FIG. 10 illustrates a front view of the base unit of FIG. 9.
Figure 12:
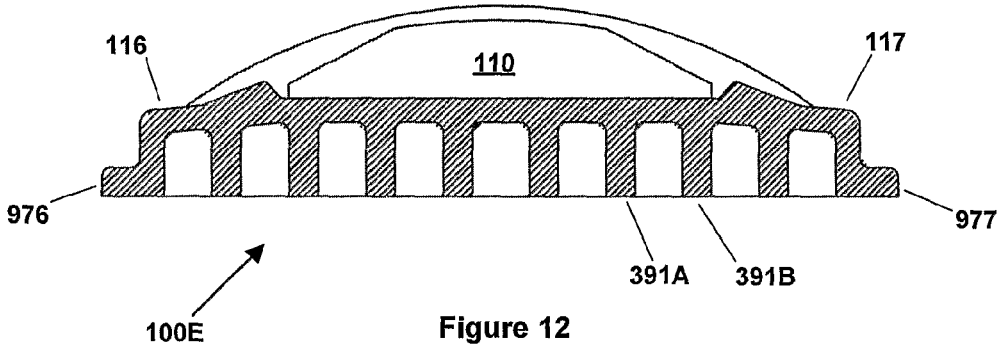
FIG. 12 is a longitudinal section through the centre of the base unit of FIG. 9.
Figure 13:
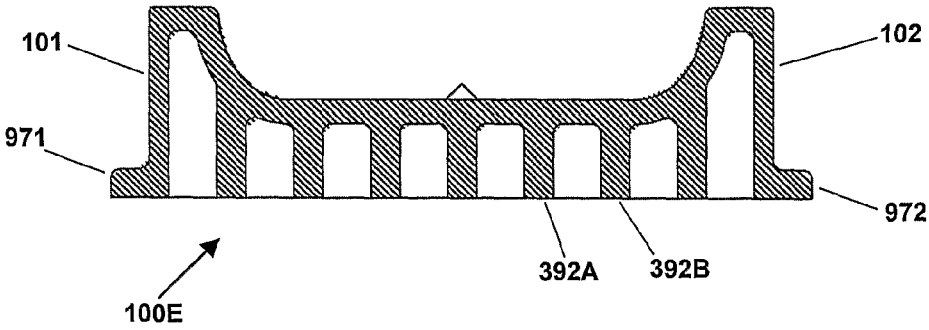
FIG. 13 is a transverse section through the centre of the base unit of FIG. 9.
Figure 11:
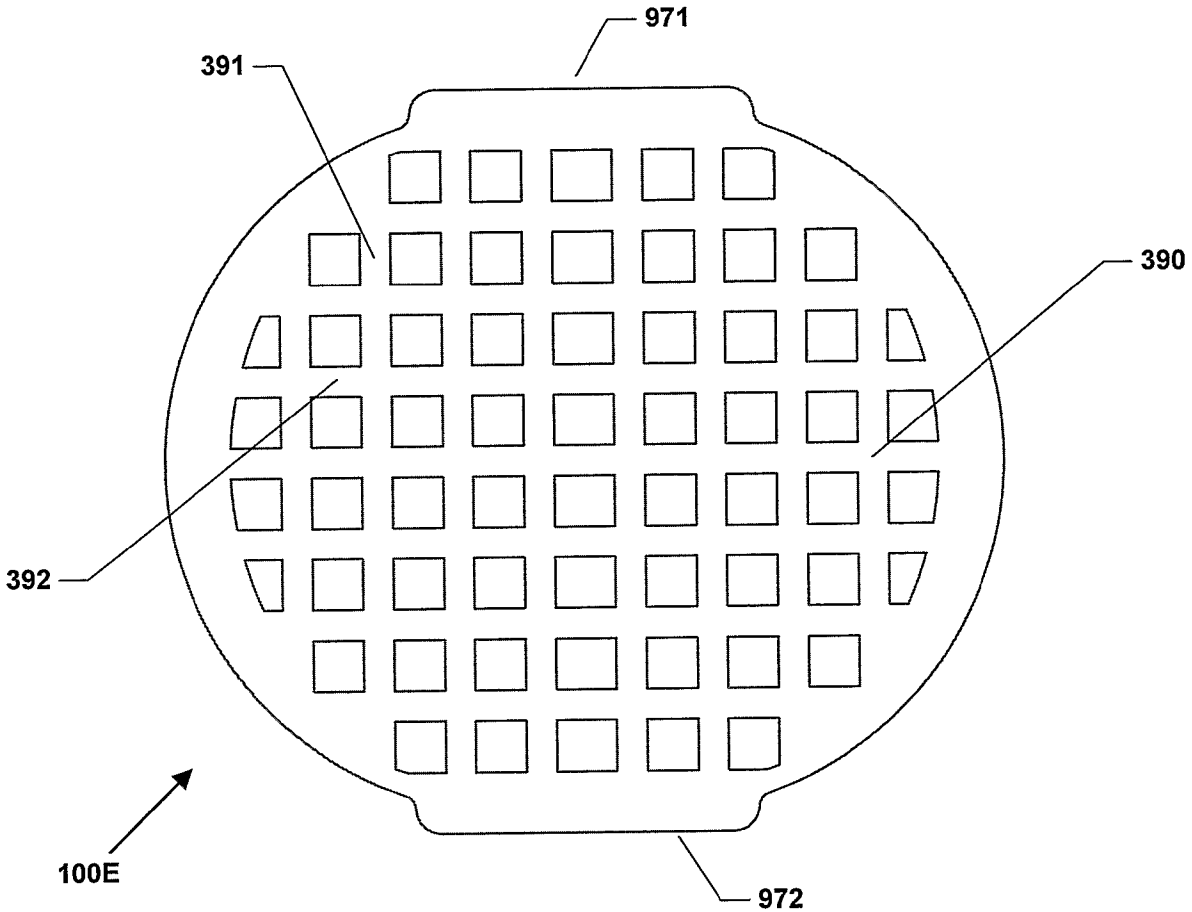
FIG. 11 represents a view of the base unit of FIG. 9 from underneath in accordance with one embodiment of the invention.

FIGS. 9-13 illustrate an alternative embodiment of the invention, in which a road stud comprises a plastic base unit 100E with a plastic reflector (rather than a depressible) stuck onto it (i.e. a hybrid type of road stud). In particular, FIG. 9 illustrates a plan view of such a plastic base unit; FIG. 10 illustrates a front view of such a plastic base unit; FIG. 11 illustrates a view of base unit 100E from underneath; and FIGS. 12 and 13 comprise a longitudinal and transverse cross-section of base unit 100E respectively. It will be appreciated that the plastic base unit of FIGS. 9-13 is significantly lighter than the cast iron base used in conventional hybrid road studs.

Like plastic base unit 100 of FIG. 1, plastic base unit 100E of FIGS. 9-13 comprises side walls 101, 102 which define a recess 110 between front and rear portions 116, 117 for receiving a (plastic) reflector (not shown in the Figures). The front portion 116 is provided with central ridge 126, while the rear portion is provided with central ridge 127 (akin to plastic base unit 100 of FIG. 1). Plastic base unit 100E is also provided with four shallow channels 991A, 991B, 992A, 992B. In particular, channels 991A and 992A extend from the front portion of the base unit to the floor of recess 110, while channels 991B and 992B extend from the rear portion of the base unit to the floor of recess 110. After a plastic reflector has been stuck onto the floor of recess 110, channels 991, 992 enable a tool to be inserted underneath the reflector to allow the reflector to be prised away from base unit 100E (for example if the reflector has become damaged and needs to be replaced).

It will be appreciated that base unit 100E is not as deep as base unit 100 of FIG. 1, since it does not have to accommodate a depressible insert, but rather only a relatively flat, stick-on reflector. Thus front portion 116 and rear portion 117 are substantially level with the floor of recess 110 to allow good visibility of the reflector. In one embodiment, front portion 116 and rear portion 117 are inclined slightly downwards away from the centre of the base unit 100E (see FIG. 12). This prevents the build-up of water in recess 110 by directing rainwater away from base unit 100E. (In contrast, the front portion 116 and rear portion 117 of the base unit 100 of FIG. 1 have the opposite inclination, and thereby act to channel water into recess 110 for use in the wiping action).

The bottom of side wall 101 is provided with an outwardly facing lip 971, and the bottom of side wall 102 is provided with a corresponding outwardly facing lip 972. In addition, the bottom of front portion 116 is provided with a forward facing lip 976 and the rear portion 117 is provided with a backwards facing lip 977. During the installation of base unit 100E, lips 971, 972, 976 and 977 are covered by bitumen or other road grout, and so help to retain the base unit 100E within the road.

The tops of side walls 101, 102 are textured to provide an anti-skid or anti-slip surface 120, analogous to the anti-skid surface 120 of base unit 100A of FIG. 2. As discussed in relation to the embodiment of FIG. 2, this anti-skid surface can have any appropriate shape or texture, and may extend over all or just part of the tops of side walls 101, 102.

The embodiment of FIGS. 9-13 includes an anti-frogging pattern 390 on the bottom of base unit 100E. In particular, the underside of the base unit 100E comprises a cavity that extends under substantially the whole of base unit 100E. This cavity is spanned by a grid of transverse walls 391A, 391B and longitudinal walls 392A, 392B that not only strengthen base unit 100E but also provide anti-frogging pattern 390. It will be appreciated that anti-frogging pattern 390 aids installation of base unit 100E in the same way as discussed above in relation to base unit 100C of FIG. 3A.

Note that the anti-frogging pattern 390 of base unit 100E extends under the floor of recess 110 (as well as under front and rear portions 116, 117), in contrast to the anti-frogging pattern 390 of base unit 100C of FIG. 3A, which extends only under front and rear portions 116, 117, but not under the floor of recess 110. This difference reflects the fact that recess 110 in base unit 100C is deeper than recess 110 in base unit 110E in order to receive a depressible insert (compared to a plastic stick-on reflector).

It will be appreciated that the exact choice of plastic material for the base unit (of any of the described embodiments) is dependent upon considerations such as impact resistance, wear resistance, and environmental resistance (e.g. in respect of sunlight and rain). This may lead to different plastic materials being used in different locations. For example, the geographical location of a road stud affects the amount of rain, sunshine, temperature, and other environmental factors experienced by the road stud. Similarly, the positioning of a road stud within the road and the pattern of traffic using the road affects the amount of wear experienced by the road stud. Consequently, it may be appropriate to use different plastic materials having different wear, impact and environmental resistance, to provide the most durable road stud for any given location.

It is also possible to add a colourant to the plastic material for the base unit of any of the described embodiments in order to make a coloured base unit. Thus for existing road studs, some of the reflectors are coloured. For example, it is common to use white reflectors to indicate the internal lanes of a motorway, green reflectors to indicate a slip road leaving the motorway, red reflectors to indicate a slip road joining a motorway (thereby warning a motorist not to turn at this junction), and amber reflectors to indicate the sides of the motorway carriage-way.

By adding a colourant to the plastic material for the base unit, the colour of the base unit can be made to match the colour of the reflector(s)—i.e. a white, amber, red, or green base unit, as appropriate. With this approach, the colour of the base unit, which has a relatively large exposed surface area, would primarily be visible during daylight, and the colour of the reflector primarily visible at night-time. One advantage of using a colourant to incorporate colour into the material of the base unit (rather than just applying the colour to the base unit as a surface coating, such as by painting), is that the base unit retains the colour even if the exposed surface of the base unit suffers wear due to passing traffic.

In some embodiments, a luminescent colourant or dopant is added to the plastic so that the base unit luminesces (e.g. fluoresces or phosphoresces), for example in response to passing car headlights. This would then allow the base units themselves to be visible at night-time, which would be especially helpful for improving the visibility of road studs outside a direct headlight beam, such as on corners or for cyclists.

A further possibility is to colour the resilient insert of a road stud to match the reflector and/or the base unit. Existing depressible inserts are generally white, but these could be coloured as appropriate, using some suitable material or surface treatment for the insert.

It will also be appreciated that rather than providing matching colours for the reflectors, base unit and/or insert, contrasting colours could be used instead. This contrast may help with the visibility and noticeability of the road stud in appropriate circumstances.

In conclusion, although a variety of embodiments have been described herein, these are provided by way of example only, and there are many further possible combinations of the features of the different embodiments or additions thereto. Thus many variations and modifications on the described embodiments will be apparent to the skilled person and fall within the scope of the present invention, which is defined by the appended claims and their equivalents.

What is claimed is:

1. A base unit for a road stud, said base unit being made of plastic and having a recess with a plurality of projections, said base unit including a floor underneath the recess, said projections extending over the floor for retaining a resilient insert within the recess, wherein said base unit comprises a body provided by a first portion, said first portion including one or more apertures in the floor of the recess, and said base unit further comprises one or more additional portions, each of said one or more additional portions being fitted into a corresponding aperture in the floor of the recess, wherein said projections are formed as a single injection molding with said first portion and extend over the one or more apertures in the floor of the recess into which the corresponding additional portions are fitted, and wherein said first portion forms the top surface of the base unit, such that the one or more additional portions do not extend above the body of the base unit.

2. The base unit of claim 1, wherein said one or more additional portions are fitted by adhesive bonding.

3. The base unit of claim 1, wherein said one or more additional portions are fitted by a snap or press fit.

4. The base unit of claim 1, wherein said one or more additional portions are fitted by acoustic welding.

5. The base unit of claim 1, wherein there is at least one projection on each of two opposing sides of the recess, and wherein said one or more additional portions comprise a single floor piece that extends from one of said opposing sides to the other.

6. The base unit of claim 1, wherein there is at least one projection on each of two opposing sides of the recess, and wherein said one or more additional portions comprise a first floor piece located adjacent to one of said two opposing sides, and a second floor piece located adjacent to the other of said two opposing sides.

7. The base unit of claim 1, wherein there are multiple projections on each of two opposing sides of the recess, and wherein said one or more additional portions comprise a separate floor piece located underneath each of said multiple projections.

8. A road stud comprising a base unit and a resilient insert, said insert being made of rubber and supporting one or more reflectors, said base unit being made of plastic and having a recess with a plurality of projections, said base unit including a floor underneath the recess, said projections extending over the floor and retaining the resilient insert within the recess, wherein said base unit comprises a body provided by a first portion, said first portion including one or more apertures in the floor of the recess, and said base unit further comprises one or more additional portions, each of said one or more additional portions being fitted into a corresponding aperture in the floor of the recess, wherein said projections are formed as a single injection moulding with said first portion and extend over the one or more apertures in the floor of the recess into which the corresponding additional portions are fitted, wherein the resilient insert protrudes slightly above a top surface of the base unit, and can be compressed into the recess below the top surface of the base unit by the wheel of a passing vehicle.

9. The road stud of claim 8, wherein said one or more additional portions are fitted by adhesive bonding.

10. The road stud of claim 8, wherein said one or more additional portions are fitted by a snap or press fit.

11. The road stud of claim 8, wherein said one or more additional portions are fitted by acoustic welding.

12. The road stud of claim 8, wherein there is at least one projection on each of two opposing sides of the recess, and wherein said one or more additional portions comprise a single floor piece that extends from one of said opposing sides to the other.

13. The road stud of claim 8, wherein there is at least one projection on each of two opposing sides of the recess, and wherein said one or more additional portions comprise a first floor piece located adjacent to one of said two opposing sides, and a second floor piece located adjacent to the other of said two opposing sides.

14. The road stud of claim 8, wherein there are multiple projections on each of two opposing sides of the recess, and wherein said one or more additional portions comprise a separate floor piece located underneath each of said multiple projections.

* * * * *